US010488785B2

(12) United States Patent
Kakuta et al.

(10) Patent No.: US 10,488,785 B2
(45) Date of Patent: Nov. 26, 2019

(54) DEVELOPING UNIT, PROCESS CARTRIDGE, AND IMAGE FORMING APPARATUS INCLUDING PROCESS CARTRIDGE

(71) Applicant: CANON KABUSHIKI KAISHA, Tokyo (JP)

(72) Inventors: Hideki Kakuta, Suntou-gun (JP); Yuuki Nakamura, Mishima (JP); Shota Nakamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/892,244

(22) Filed: Feb. 8, 2018

(65) Prior Publication Data

US 2018/0231917 A1 Aug. 16, 2018

(30) Foreign Application Priority Data

Feb. 14, 2017 (JP) ..... 2017-025413

(51) Int. Cl.
*G03G 15/08* (2006.01)
*G03G 21/18* (2006.01)

(52) U.S. Cl.
CPC ..... *G03G 15/0817* (2013.01); *G03G 21/185* (2013.01)

(58) Field of Classification Search
CPC ..... G03G 15/0817
See application file for complete search history.

(56) References Cited

U.S. PATENT DOCUMENTS 3,667,428 A * 6/1972 Smith ..... G03D 5/067 399/239
2016/0282754 A1* 9/2016 Kuramoto ..... G03G 15/0812

FOREIGN PATENT DOCUMENTS

| | | | |
|---|---|---|---|
| JP | 2000-275965 | A | 10/2000 |
| JP | 2004-151228 | A | 5/2004 |
| JP | 2007-72176 | A | 3/2007 |
| JP | 2009-244450 | A | 10/2009 |

* cited by examiner

*Primary Examiner* — Sevan A Aydin
(74) *Attorney, Agent, or Firm* — Canon U.S.A., Inc. I.P. Division

(57) ABSTRACT

A developing unit includes a developer bearing member, a container, an end seal, a sheet, and a backup member. The container contains a developer. The container has an opening for supplying the developer to the developer bearing member. The end seal is disposed between the developer bearing member and the developer container. The end seal is disposed at an area of the container outside a longitudinal end of the opening. The sheet seals a gap between the developer bearing member and the container. One widthwise end of the sheet is fixed to the container. The other widthwise end is in contact with the developer bearing member. A longitudinal end of the sheet includes a sandwiched portion between the end seal and the developer bearing member. The backup member is provided in an area facing a surface of the sheet opposite to a surface in contact with the developer bearing member.

7 Claims, 7 Drawing Sheets

DEVELOPING UNIT, PROCESS CARTRIDGE, AND IMAGE FORMING APPARATUS INCLUDING PROCESS CARTRIDGE

BACKGROUND OF THE INVENTION

Field of the Invention

The present disclosure relates to a developing unit, a process cartridge, and an electrophotographic image forming apparatus including the process cartridge.

The electrophotographic image forming apparatus (hereinafter referred to as "image forming apparatus") forms an image on a recording material (a recording medium) using an electrophotographic image forming system. Examples of the image forming apparatus include copiers, printers (laser printers, LED printers, and so on), facsimile machines, word processors, and multifunctional apparatuses thereof (multifunctional printers).

Description of the Related Art

Image forming apparatuses using the electrophotographic image forming system (an electrophotographic process), such as printers, uniformly charge an electrophotographic photosensitive member (hereinafter referred to as "photosensitive member"), which is an image bearing member. Next, the image forming apparatuses selectively expose the charged photosensitive member to form an electrostatic latent image on the photosensitive member. Thereafter, the electrostatic latent image formed on the photosensitive member is visualized as a toner image using a toner, or a developer. The image forming apparatuses transfer the toner image formed on the photosensitive member to a recording material, such as recording paper or a plastic sheet, and apply heat or pressure to the toner image transferred to the recording material to fix the toner image to the recording material to record the image.

The image forming apparatuses includes a developer bearing member at an opening of a developer container containing a developer and supply the toner to an electrostatic latent image on the photosensitive member to form a toner image. In order to prevent the developer for developing the electrostatic latent image from leaking from a developing unit or a process cartridge, an end sealing member for sealing the gap between the developer bearing member and the developer container is provided at the both longitudinal ends of the developer container. Furthermore, in order to prevent the developer from blowing out from between the developer bearing member and the opening of the developer container, a sealing member one end of which is fixed to the opening and the other end of which is in contact with the developer bearing member is provided in the longitudinal direction of the developer container.

In order to prevent the sealing member from turning up when the developer in the developer container presses against the sealing member, some of the image forming apparatuses include a developer-leakage preventing unit in an area facing a surface at which the sealing member and the developer bearing member are in contact. (Japanese Patent Laid-Open No. 2000-275965)

To facilitate maintenance of the processing unit, it has been put into practical use to combine a photosensitive drum, a charging unit, a developing unit, a cleaning unit, and so on in a process cartridge, which is detachably attached to an image forming apparatus (an apparatus main body).

SUMMARY OF THE INVENTION

According to an aspect of this disclosure, we provide a developing unit including a developer bearing member, a container, an end seal, a sheet, and a backup member. The developer bearing member is configured to bear a developer. The container contains the developer and rotatably supports the developer bearing member. The container has an opening for supplying the developer to the developer bearing member, the opening being long in a longitudinal direction of the developer bearing member. The end seal is disposed between the developer bearing member and the developer container, the end seal being disposed at an area of the container outside an end of the opening in the longitudinal direction. The sheet is long in the longitudinal direction, the sheet sealing a gap between the developer bearing member and the container. A first widthwise end of the sheet, in a widthwise direction perpendicular to the longitudinal direction, is fixed to the container. A second widthwise end of the sheet, opposite to the first widthwise end of the sheet in the widthwise direction, is in contact with the developer bearing member. A longitudinal end of the sheet includes a sandwiched portion sandwiched between the end seal and the developer bearing member. The backup member is provided in an area facing a surface of the sheet opposite to a surface in contact with the developer bearing member. The area is next to the end seal on the opening side in the longitudinal direction and has at least part of the backup member being fixed to the container. The backup member is in contact with the opposite surface of the sheet in a state in which the developer bearing member is supported by the container.

Further features of the present disclosure will become apparent from the following description of exemplary embodiments with reference to the attached drawings.

DESCRIPTION OF THE EMBODIMENTS

First Embodiment

Electrophotographic Image Forming Apparatus

Figure 2:
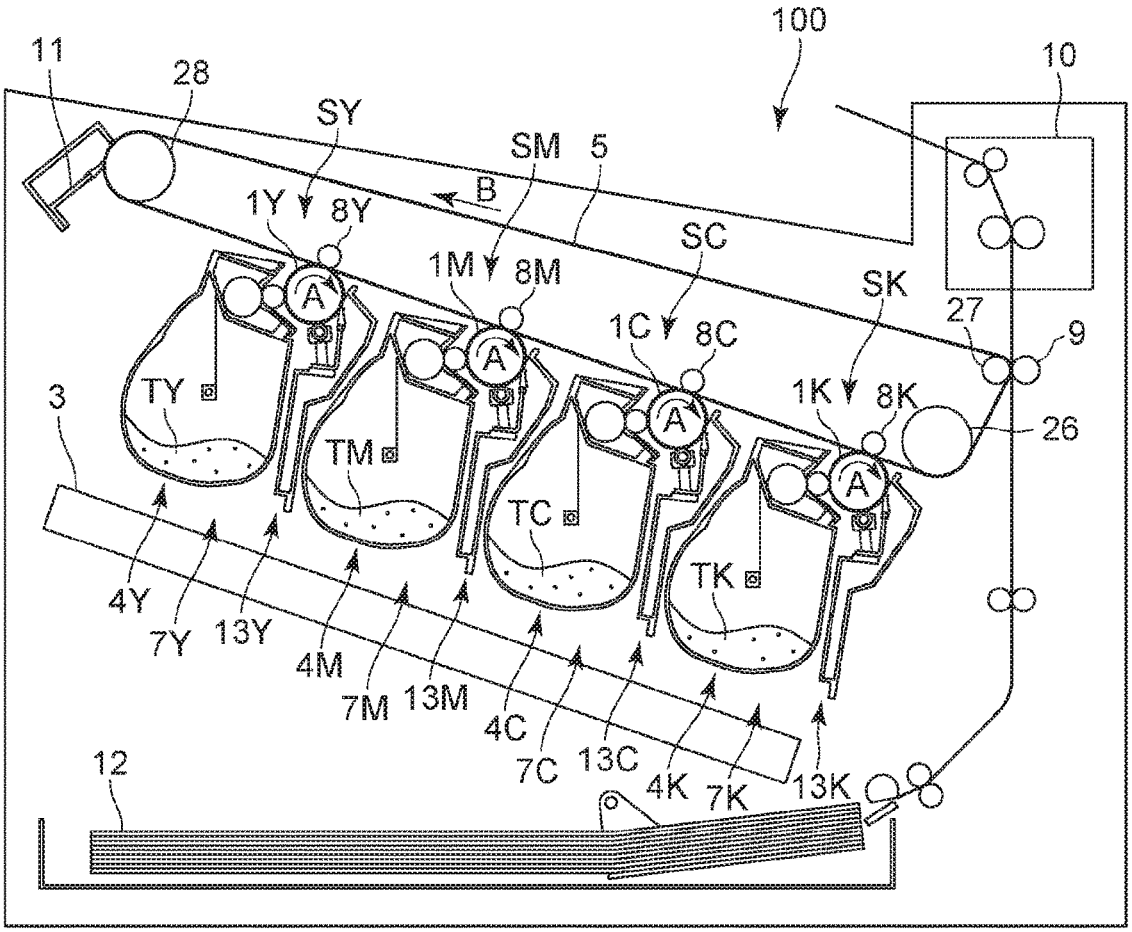
FIG. 2 is a schematic cross-sectional view of an image forming apparatus and process cartridges according to the first embodiment of the present embodiment.
Figure 3:
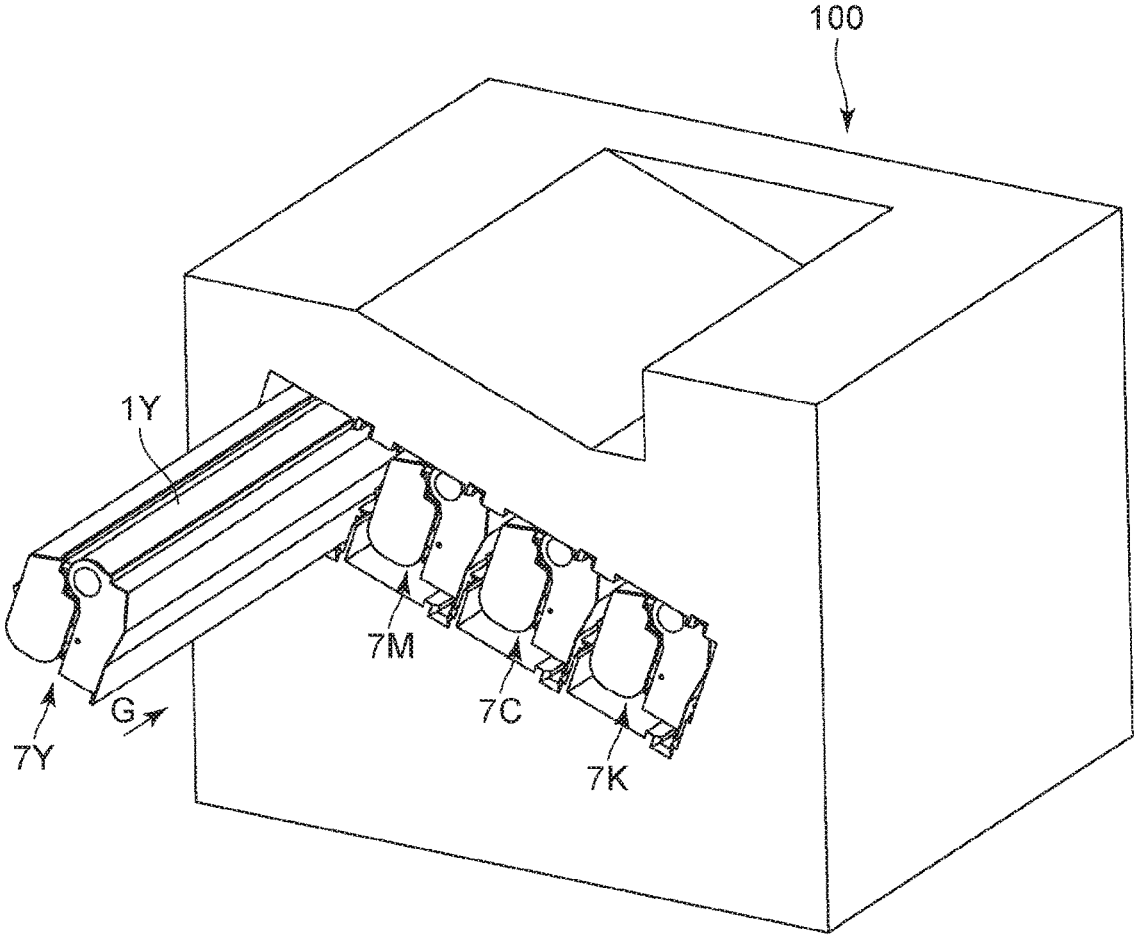
FIG. 3 is a perspective view of the image forming apparatus and the process cartridges according to the first embodiment of the present embodiment.

First, the overall configuration of an electrophotographic image forming apparatus (an image forming apparatus) 100 according to a first embodiment of the present disclosure will be described with reference to FIGS. 2 and 3. FIG. 2 is a schematic cross-sectional view of the image forming apparatus 100 of the present embodiment. FIG. 3 is a perspective view of the image forming apparatus 100 in a state in which a process cartridge 7 (a cartridge) is being attached.

The image forming apparatus 100 includes a plurality of image forming units, that is, first to fourth image forming units SY, SM, SC, and SK for forming yellow (Y), magenta (M), cyan (C), and black (K) images. The image forming apparatus 100 further includes a scanner unit (an exposing unit) 3 vertically below the first to fourth image forming units SY, SM, SC, and SK. The scanner unit 3 is an exposing unit that forms an electrostatic latent image (an electrostatic image) on a photosensitive drum 1 by applying laser beams on the basis of image information.

In the present embodiment, the configurations and operations of the first to fourth image forming units SY, SM, SC, and SK are substantially the same except that the colors of images to be formed differ. In other words, cartridges 7 (7Y, 7M, 7C, and 7K) to be respectively attached to the first to fourth image forming units SY, SM, SC, and SK respectively contain yellow, magenta, cyan, and black toners T (TY, TM, TC, and TK) and have the same shape. For that reason, signs Y, M, C, and K will be omitted, and general description will be given in the following description when no distinction is required.

The cartridges 7 each include a photosensitive unit 13 (13Y, 13M, 13C, or 13K) including the electrophotographic photosensitive member (hereinafter referred to as "photosensitive drum) 1 (1Y, 1M, 1C, or 1K) and a developing unit 4 (4Y, 4M, 4C, or 4K). Thus, in the present embodiment, the developing unit 4 and the photosensitive unit 13 are combined into the process cartridge 7. The process cartridge 7 is detachably attached to the image forming apparatus 100 using an attaching unit, such as an attaching guide or a positioning member (not shown), provided in the image forming apparatus 100. In the present embodiment, the process cartridge 7 is detachably attachable to the image forming apparatus 100 along the axis of the photosensitive drum 1, as indicated by arrow G in FIG. 3.

Vertically above the first to fourth image forming units SY, SM, SC, and SK, an intermediate transfer belt 5 serving as an intermediate transfer member for transferring toner images on the photosensitive drums 1 to a recording material 12 is opposed to the four photosensitive drums 1. The intermediate transfer belt 5 is in contact with all the photosensitive drums 1 and rotates in the direction of arrow B in FIG. 2. The intermediate transfer belt 5 is stretched round a plurality of support members (a driving roller 26, a secondary-transfer facing roller 27, and a driven roller 28). Four primary transfer rollers 8 (8Y, 8M, 8C, and 8K) serving as primary transfer units are disposed side by side on the inner circumferential surface of the intermediate transfer belt 5 in such a manner as to face the photosensitive drums 1. Thus, during image formation, the four primary transfer rollers 8 are in contact with the photosensitive drums 1 with the intermediate transfer belt 5 therebetween. A secondary transfer roller 9 serving as a secondary transfer unit is disposed at a position of the outer circumferential surface of the intermediate transfer belt 5 facing the secondary-transfer facing roller 27. The image forming apparatus 100 further includes a fixing unit 10 above the secondary transfer roller 9.

Process Cartridge

Figure 4:
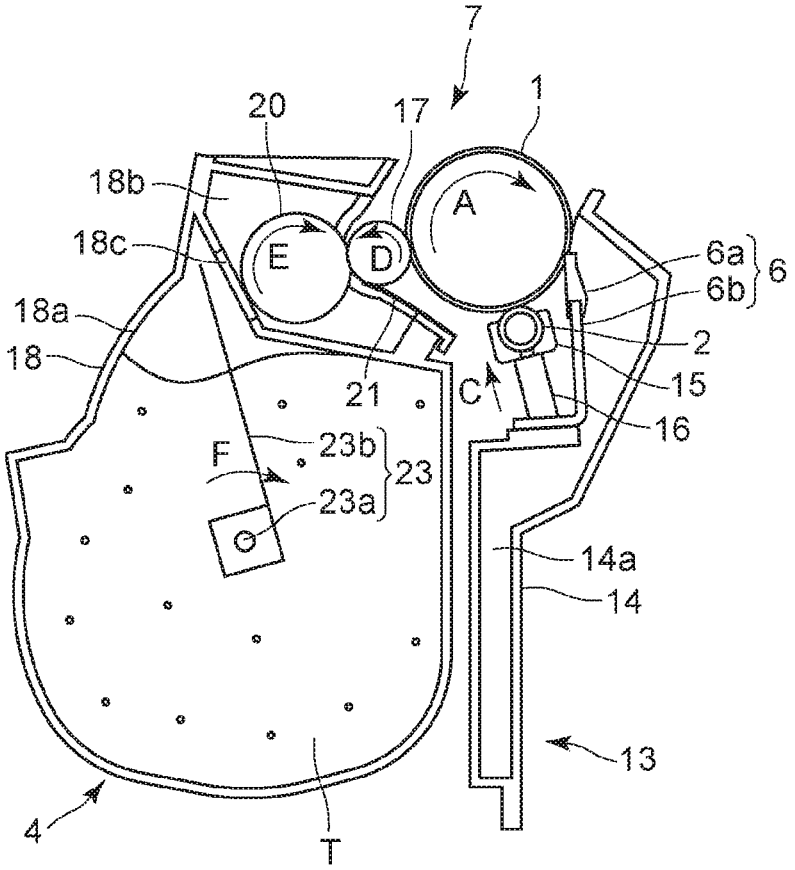
FIG. 4 is a schematic cross-sectional view of the process cartridge according to the first embodiment of the present embodiment.

Next, the overall configuration of each process cartridge 7 to be attached to the image forming apparatus 100 of the resent embodiment will be described with reference to FIG. 4. FIG. 4 is a schematic cross-sectional view of the process cartridge 7.

The developing unit 4 includes a developer container 18 that supports various components in the developing unit 4. The developing unit 4 includes a developing roller 17 which is a developer bearing member and which rotates in the direction of arrow D (counterclockwise) in FIG. 4 while being in contact with the photosensitive drum 1. In other words, the developing unit 4 in the present embodiment performs contact development of developing an electrostatic latent image by making the developing roller 17 serving as a developer bearing member contact with the photosensitive drum 1. The developing roller 17 is rotatably supported by the developer container 18 at both ends in the longitudinal direction (along the rotation axis) via bearings.

The developing unit 4 further includes a developer containing chamber (hereinafter referred to as "toner containing chamber") 18*a*, a developing chamber 18*b* in which the developing roller 17 is disposed, and an opening 18*c* that communicates the toner containing chamber 18*a* and the developing chamber 18*b*. In the present embodiment, the developing chamber 18*b* is positioned above the toner containing chamber 18*a*. The developing chamber 18*b* contains a toner supply roller 20 which serves as a developer supply member and which rotates in the direction of arrow E while being in contact with the developing roller 17 and a developing blade 21 serving as a developer control member for controlling a toner layer on the developing roller 17.

The toner containing chamber 18*a* of the developer container 18 contains a developer conveying unit 23 for stirring the contained toner T and conveying the toner T to the toner supply roller 20 through the opening 18*c*. The toner conveying unit 23 includes a rotation shaft 23*a* which is parallel to the rotation axis of the developing roller 17 and rotates in the direction of arrow F in FIG. 4 and a developer conveying sheet member (hereinafter referred to as "stirring sheet") 23*b* one end of which is attached to the rotation shaft 23*a* and which stirs and conveys the toner T. In the present embodiment, a nonmagnetic one-component developer, that is, toner T (TY, TM, TC, or TK) is contained as the developer in the toner containing chamber 18*a*.

The photosensitive unit 13 includes a cleaning frame 14 serving as a housing that supports various components in the photosensitive unit 13. As illustrated in FIG. 4, the photosensitive drum 1 is attached to the cleaning frame 14 via bearing members so as to be rotatable in the direction of arrow A.

Furthermore, a charge roller 2 is rotatably attached to the cleaning frame 14 via a charge roller bearing 15. The charge roller bearing 15 is attached so as to be movable along a line passing through the rotation center of the charge roller 2 and the rotation center of the photosensitive drum 1 and is urged toward the photosensitive drum 1 by a charge roller pressing spring 16. The charge roller bearing 15 is movably attached in this manner, and the charge roller 2 is urged in the direction of arrow C, as illustrated in FIG. 4.

Furthermore, a cleaning blade 6 for removing transfer residual toner (waste toner) remaining on the surface of the photosensitive drum 1 after the primary transfer is fixed to the cleaning frame 14. The cleaning blade 6 is a combination of an elastic member 6*a* and a support member 6*b* for supporting the elastic member 6*a*.

The cleaning frame 14 includes a removed-developer containing portion (hereinafter referred to as "waste-toner containing portion") 14*a* for containing the transfer residual toner (waste toner) removed by the cleaning blade 6.

Image Forming Process

In forming an image, first, the surface of the photosensitive drum 1 is uniformly charged by the charge roller 2. Next, the charged surface of the photosensitive drum 1 is scanned and exposed by laser light according to image information generated from the scanner unit 3, and an electrostatic latent image according to the image information is formed on the photosensitive drum 1. Next, the electrostatic latent image formed on the photosensitive drum 1 is developed as a toner image by the developing unit 4. The toner image formed on the photosensitive drum 1 is transferred (primarily transferred) onto the intermediate transfer belt 5 by the operation of the primary transfer roller 8.

For example, in forming a full-color image, the above process is performed in sequence in the first to fourth image forming units SY, SM, SC, and SK to superpose and primarily transfer color toner images onto the intermediate transfer belt 5. Thereafter, the recording material 12 is conveyed to the secondary transfer unit in synchronism with the movement of the intermediate transfer belt 5. The four color toner images on the intermediate transfer belt 5 are collectively secondarily transferred onto the recording material 12 by the operation of the secondary transfer roller 9 which is in contact with the intermediate transfer belt 5 with the recording material 12 therebetween.

The recording material 12 to which the toner images are transferred is conveyed to the fixing unit 10. By applying heat and pressure to the recording material 12 in the fixing unit 10, the toner images are fixed to the recording material 12.

Primary transfer residual toner remaining on the photosensitive drum 1 after the primary transfer process is removed by the cleaning blade 6. The waste toner removed from the surface of the photosensitive drum 1 by the cleaning blade 6 drops in the direction of gravity in a space formed by the cleaning blade 6 and the cleaning frame 14 into the waste-toner containing portion 14*a*. Secondary transfer residual toner remaining on the intermediate transfer belt 5 after secondary transfer processing is removed by an intermediate-transfer-belt cleaning unit 11. The removed transfer residual toner (waste toner) is discharged to a waste toner box (not shown) of the image forming apparatus 100.

In addition to the full-color image formation using all the image forming units SY, SM, SC, and SK, the image forming apparatus 100 is configured to be capable of forming a monochrome or multicolor image using a desired single or several image forming units S alone.

Toner Leakage Preventing Unit

Figure 1:
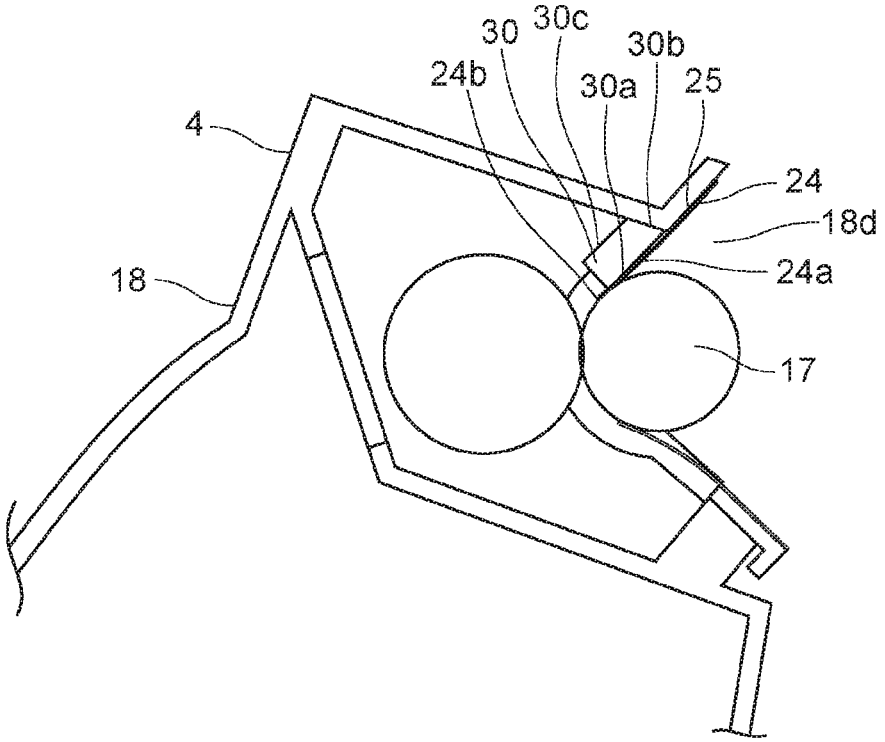
FIG. 1 is a partial enlarged cross-sectional view of a process cartridge according to a first embodiment of the present disclosure.
Figure 5:
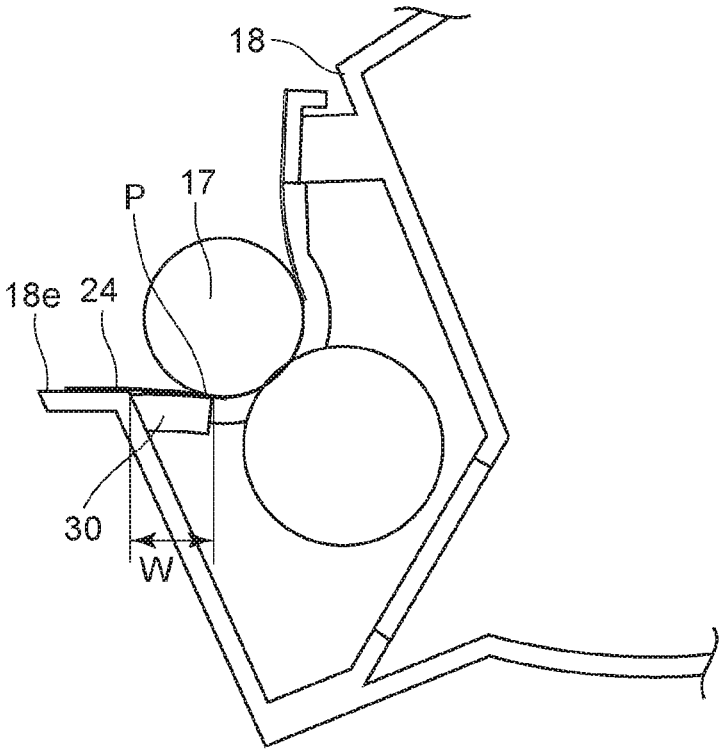
FIG. 5 is a partial cross-sectional view of the process cartridge according to the first embodiment of the present embodiment.
Figure 6:
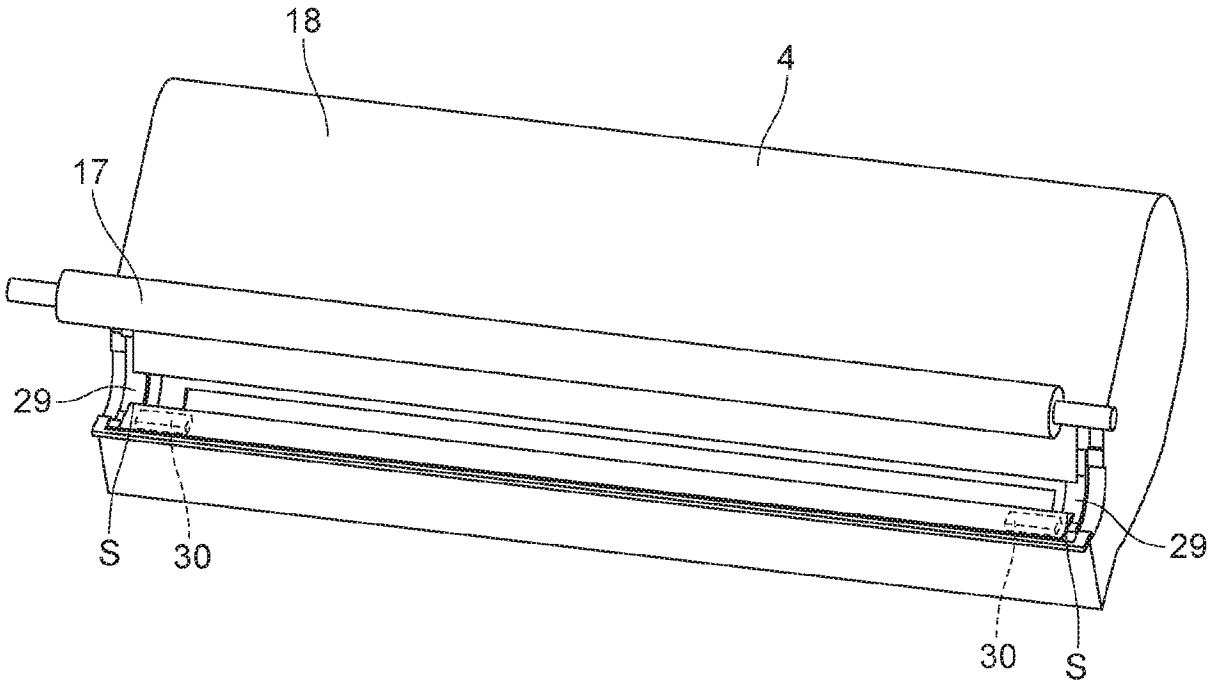
FIG. 6 is a perspective view of the process cartridge according to the first embodiment of the present embodiment.

A toner leakage preventing unit around the developing roller 17 in the present embodiment will be described with reference to FIGS. 1, 5, and 6. FIG. 1 is a partial enlarged cross-sectional view of the developing unit 4. FIG. 5 is a cross-sectional view of the developer container 18 viewed with reference to an attachment surface 18*e* of a sealing member 24. FIG. 6 is a perspective view of the developing unit 4 in a state in which the developing roller 17 is removed.

As illustrated in FIG. 1, the developer container 18 has an opening 18*d*, and the developing roller 17 is disposed so that part of the circumferential surface thereof is exposed through the opening 18*d* to the outside of the developing unit 4. As illustrated in FIG. 6, end seals 29 for sealing the gap between the developing roller 17 and the developer container 18 are disposed at both longitudinal ends of the developer container 18. More specifically, the end seals 29 are bonded to portions of the developer container 18 outside in the axial direction of the developing roller 17. The sealing member (sheet) 24 is disposed to prevent the toner T in the developer container 18 from leaking to the outside through the gap between a side of the opening 18*d* of the developer container 18 extending in the axial direction of the developing roller 17 and the developing roller 17. The sealing member 24 is formed of a sheet member, such as a polyester sheet. The sealing member 24 is fixed to the developer container 18 by bonding one widthwise end thereof to the axially extending side of the opening 18*d* of the developer container 18 with a double-faced adhesive tape 25 or the like. The other lateral end of the sealing member 24 is in contact with (abuts) the surface of the developing roller 17. More specifically, the sealing member 24 includes a contact surface 24*a* in contact with the developing roller 17 and an opposite surface 24*b* opposite to the contact surface 24*a*. The opposite surface 24*b* is bonded to the developer container 18. The opposite surface 24*b* is the surface opposite to the surface of the sealing member 24 in contact with the developing roller 17.

In the present embodiment, sealing assist members (backup members) 30 are disposed on the developer container 18 in such a manner as to be in contact with the opposite surface 24*b* of the sealing member 24. In other words, the sealing assist members 30 are disposed in the axial direction of the developing roller 17 on the opening 18*d* side of the end seals 29 so as to be next to the end seals 29. In the present embodiment, the sealing assist members 30 are disposed in contact with the end seals 29 in the axial direction of the developing roller 17. This is given for mere illustration. It is only required that the distance between the end seals 29 and the sealing assist members 30 is 0.7 mm or less. The sealing assist members 30 are formed of a flexible material, for example, a foamed material, such as foamed polyurethane, or an elastic material, such as elastomer. The sealing assist members 30 abut (contact) the sealing member 24 at an urging surface 30*a*. A surface 30*b* next to the urging surface 30*a* via a side serves as an adhesive surface and is bonded to the inner wall of the developer container 18 with a double-faced adhesive tape or the like. In other words, the sealing assist members 30 are rectangular in cross section in a direction orthogonal to the axial direction before being compressed and have a bonding member at the urging surface 30*a* in contact with the sealing member 24 and the adhesive surface 30*b*. As illustrated in FIG. 5, the lateral width W of the sealing assist members 30 may be set so that the sealing assist members 30 extend from the developer container 18 beyond a line orthogonal to the fixing surface of the sealing member 24. In this case, the sealing assist members 30 are preferably disposed so that the protruding amount from the end of the sealing member 24 is less than 0.5 mm from the viewpoint of reducing the influence on the image.

Conventionally, when the developing roller 17 is rotationally driven at high speed to perform high speed printing, the toner on the developing roller 17 can be scraped in high contact pressure areas (sandwiched areas) S where the end seals 29 and the developing roller 17 overlap (see FIG. 6). In these areas S, the longitudinal ends of the sealing member 24 are sandwiched between the end seals 29 and the developing roller 17.

Also when the developing roller 17 is rotationally driven after the developing unit 4 is used for a long time, the toner on the developing roller 17 can be scraped in the areas S. The scraped toner can be moved inward in the longitudinal direction of the developer container 18 (in the axial direction of the developing roller 17) due to an air flow or the like in the image forming apparatus and be sometimes caught between the developing roller 17 and the sealing member 24. As a result of the toner being caught between the developing roller 17 and the sealing member 24, the toner can leak, more specifically, can be blown out from the developer container 18 every time the toner conveying unit 23 is driven in the developer container 18.

However, in the present embodiment, the sealing assist members 30 are disposed at positions next to the end seals 29. This prevents the scraped toner from moving to the inside in the longitudinal direction of the developer container 18 due to the air flow or the like in the image forming apparatus. As a result, the scraped toner is caught between the developing roller 17 and the sealing member 24. This prevents the scraped toner from being caught between the developing roller 17 and the sealing member 24 to leak, more specifically, to be blown out from the developer container 18 every time the toner conveying unit 23 is driven in the developer container 18.

In addition, the surfaces 30*b* of the sealing assist members 30 next to the urging surfaces 30*a* in contact with the sealing member 24 via a side are used as adhesive surfaces and are bonded to the inner wall of the developer container 18 with a double-faced adhesive tape or the like. In other words, a space is formed between surfaces 30*c* opposite to the urging surfaces 30*a* in contact with the sealing member 24 and the inner wall of the developer container 18 (FIG. 1).

Furthermore, the sealing assist members 30 are disposed with respect to the developer container 18 so that the ends of the sealing assist members 30 at the end of the sealing member 24 fixed to the developer container 18 are fixed to the developer container 18, and the ends of the sealing assist members 30 at the end of the sealing member 24 in contact with the developing roller 17 are free ends.

Therefore, the space between the surfaces 30*c* of the sealing assist members 30 and the inner wall of the developer container 18 allows the sealing assist members 30 to be buckled when pressure is applied from the sealing member 24. This reduces or eliminates contact pressure of the sealing assist members 30 against the sealing member 24. This prevents the sealing member 24 from scraping the toner on the developing roller 17 or the contact pressure between the sealing member 24 and the developing roller 17 from increasing in the areas where the sealing assist members 30 are in contact with the sealing member 24. The pressure at which the sealing member 24 contacts the developing roller 17 is set to be lower in the areas of the sealing member 24 in contact with the sealing assist members 30 than in the sandwiched areas S of the sealing member 24. Thus, the present embodiment prevents the toner T from blowing out or leaking from the developer container 18 without damaging the surface of the developing roller 17.

Second Embodiment

Next, a second embodiment of the present disclosure will be described. The basic configurations of the image forming apparatus and the process cartridges of the present embodiment are the same as those of the first embodiment. Therefore, components having the same or corresponding functions and configurations are given the same reference signs, and detailed descriptions will be omitted.

Figure 7:
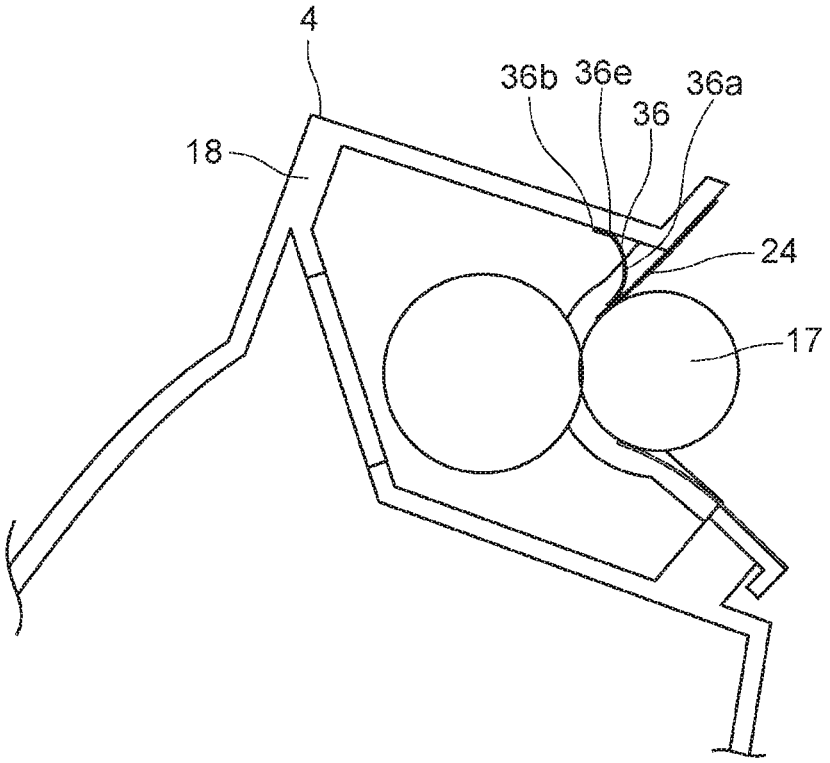
FIG. 7 is a cross-sectional view of a process cartridge according to a second embodiment of the present embodiment.

FIG. 7 is a cross-sectional view of the present embodiment. In the first embodiment, a foamed material, such as foamed polyurethane, or an elastic material, such as elastomer, is used as the sealing assist members 30. In the present embodiment, a flexible sheet member is used as a sealing assist member 36. As in the first embodiment, the sealing assist members 36 are configured such that one end in the direction orthogonal to the axial direction is fixed to the developer container 18, and the other end is in contact with the sealing member 24 on the opening 18*d* side of the end seals 29 in the axial direction. The sealing assist members 36 in the present embodiment each have a bent portion 36*e* so that a surface 36*b* is next to a surface 36*a* in contact with the sealing member 2. The sealing assist members 36 are bonded to the inner wall of the developer container 18 with a bonding material on the surface 36*b*. Since the sealing assist members 36 are formed of a sheet member, the contact pressure of the sealing assist members 36 against the sealing member 24 can be more finely adjusted by, for example, adjusting the thickness of the sheet. In the present embodiment, the sealing assist members 36 have the bent portion 36*e* extending in the axial direction. This is given for mere illustration. The sealing assist members 36 may be warped so that the surfaces 36*b* are bonded to the inner wall of the developer container 18 and the surfaces 36*a* are in contact with the sealing member 24.

With such a configuration, the contact pressure of the sealing assist members 36 with respect to the sealing member 24 can be reduced by the elasticity of the sealing assist members 36 as in the first embodiment. This therefore prevents the sealing member 24 from scraping the toner on the developing roller 17 or the contact pressure between the sealing member 24 and the developing roller 17 from increasing in the areas in which the sealing assist members 36 and the sealing member 24 are in contact. Thus, the present embodiment prevents the toner T from blowing out or leaking from the developer container 18 without damaging the surface of the developing roller 17.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-025413 filed Feb. 14, 2017, which is hereby incorporated by reference herein in its entirety.

What is claimed is:

1. A developing unit comprising:

a developer bearing member configured to bear a developer and to be rotatable;

a container containing the developer and supporting the developer bearing member so that the developer bearing member is rotatable, the container having an opening through which the developer is supplied to the developer bearing member, the opening being long in a longitudinal direction of the developer bearing member;

an end seal disposed between the developer bearing member and the container so as to seal a gap therebetween, the end seal being disposed at an area of the container outside the opening in the longitudinal direction of the developer bearing member;

a sheet that is long in the longitudinal direction of the developer bearing member, the sheet sealing a gap between the developer bearing member and the container, wherein a first widthwise end of the sheet, in a widthwise direction of the sheet perpendicular to a longitudinal direction of the sheet, is fixed to the container, wherein a second widthwise end of the sheet, opposite to the first widthwise end of the sheet in the widthwise direction of the sheet, is in contact with the developer bearing member, and wherein a longitudinal end portion of the sheet includes a sandwiched area sandwiched between the end seal and the developer bearing member; and a backup member provided separately from the container and supported by the container, the backup member being arranged so as to contact with a contact area of the sheet, the contact area of the sheet being on a surface of the sheet opposite to a surface of the sheet in contact with the developer bearing member, wherein the contact area of the sheet is arranged next to the sandwiched area of the sheet in the longitudinal direction of the sheet, and is arranged nearer to a longitudinal center of the sheet than the sandwiched area of the sheet.

2. The developing unit according to claim 1, wherein the backup member is formed of foam or elastomer.

3. The developing unit according to claim 1, wherein in the widthwise direction of the sheet, one end of the backup member on a side of the first widthwise end of the sheet is fixed to the container, and the other end of the backup member on a side of the second widthwise end of the sheet is a free end with respect to the container.

4. The developing unit according to claim 1, wherein pressure at which the second widthwise end portion of the sheet contacts the developer bearing member in the contact area of the sheet is lower than that in the sandwiched area.

5. The developing unit according to claim 1, wherein a distance between the end seal and the backup member in the longitudinal direction of the developer bearing member is 0.7 mm or less.

6. The developing unit according to claim 1, wherein the contact area of the sheet is overlapped with the sandwiched area of the sheet in the widthwise direction of the sheet when viewed in the longitudinal direction of the sheet.

7. The developing unit according to claim 1, wherein the contact area of the sheet is arranged adjacent to the sandwiched area of the sheet in the longitudinal direction of the sheet.

* * * * *